US007424909B2

(12) United States Patent
Roberts et al.

(10) Patent No.: US 7,424,909 B2
(45) Date of Patent: Sep. 16, 2008

(54) DRILLABLE BRIDGE PLUG

(75) Inventors: William M. Roberts, Tomball, TX (US); James A. Simson, Meadows Place, TX (US); George J. Melenyzer, Tomball, TX (US)

(73) Assignee: Smith International, Inc., Houston, TX (US)

( * ) Notice: Subject to any disclaimer, the term of this patent is extended or adjusted under 35 U.S.C. 154(b) by 325 days.

(21) Appl. No.: 11/064,306

(22) Filed: Feb. 23, 2005

(65) Prior Publication Data

US 2005/0189103 A1 Sep. 1, 2005

Related U.S. Application Data

(60) Provisional application No. 60/548,718, filed on Feb. 27, 2004.

(51) Int. Cl.
*E21B 23/01* (2006.01)

(52) U.S. Cl. ..... 166/118

(58) Field of Classification Search ..... 166/118, 166/386; 420/514
See application file for complete search history.

(56) References Cited

U.S. PATENT DOCUMENTS

| | | | | |
|---|---|---|---|---|
| 2,165,433 | A | 7/1939 | Wickersham | |
| 3,785,811 | A * | 1/1974 | Pelzel | 420/514 |
| 4,146,093 | A | 3/1979 | Horvath et al. | |
| 4,374,543 | A | 2/1983 | Richardson | |
| 4,593,765 | A | 6/1986 | Greenlee | |
| 4,595,052 | A | 6/1986 | Kristiansen | |
| 4,784,226 | A | 11/1988 | Wyatt | |
| 5,058,671 | A * | 10/1991 | Cochran | 166/386 |
| 5,224,540 | A | 7/1993 | Streich et al. | |
| 5,271,468 | A | 12/1993 | Streich et al. | |
| 5,333,685 | A | 8/1994 | Gilbert | |
| 6,167,963 | B1 | 1/2001 | McMahan et al. | |
| 6,491,108 | B1 * | 12/2002 | Slup et al. | 166/118 |
| 6,695,050 | B2 * | 2/2004 | Winslow et al. | 166/118 |
| 6,796,376 | B2 | 9/2004 | Frazier | |

FOREIGN PATENT DOCUMENTS

| | | |
|---|---|---|
| JP | 11-148295 | 6/1999 |
| SU | 926238 | 5/1982 |

OTHER PUBLICATIONS

Combined Search and Examination Report; British Patent Office; Appl. No. GB0503938.3; Dated Apr. 18, 2005; 6 pages.
Combined Search and Examination Report; British Patent Office; Appl. No. GB0524775.4; Dated Feb. 10, 2006; 4 pages.

* cited by examiner

*Primary Examiner*—Richard E. Chilcot, Jr.
*Assistant Examiner*—Matt J Smith
(74) *Attorney, Agent, or Firm*—Osha Liang, LLP

(57) ABSTRACT

A drillable bridge plug comprising a mandrel, a sealing element disposed around the mandrel, a plurality of backup rings adjacent the sealing element, a lower slip assembly disposed around the mandrel, an upper slip assembly disposed around the mandrel, an upper cone adjacent the upper slip assembly and engaged with the mandrel with at least one axial locking apparatus and at least one rotational locking apparatus, and a lower cone adjacent the lower slip assembly and engaged with the mandrel with at least one axial locking apparatus and at least one rotational locking apparatus. A drillable bridge plug comprising a mandrel and at least one slip assembly at least partially made of a material having less than 10% elongation.

17 Claims, 5 Drawing Sheets

DRILLABLE BRIDGE PLUG

CROSS-REFERENCE TO RELATED APPLICATIONS

This application claims priority, pursuant to 35 U.S.C. § 119(e), of U.S. Provisional Application No. 60/548,718, filed on Feb. 27, 2004. This Provisional Application is incorporated by reference in its entirety.

BACKGROUND OF INVENTION

1. Field of the Invention

The invention relates generally to methods and apparatus for drilling and completing well bores. More specifically, the invention relates to methods and apparatus for a drillable bridge plug.

2. Background Art

In drilling, completing, or reworking wells, it often becomes necessary to isolate particular zones within the well. In some applications, downhole tools, known as temporary or permanent bridge plugs, are inserted into the well to isolate zones. The purpose of the bridge plugs is to isolate some portion of the well from another portion of the well. In some instances, perforations in the well in one section need to be isolated from perforations in another section of the well. In other situations, there may be a need to use a bridge plug to isolate the bottom of the well from the wellhead.

When it is desired to remove one or more of these bridge plugs from a wellbore, it is often simpler and less expensive to mill or drill them out rather than to implement a complex retrieving operation. In milling, a milling cutter is used to grind the tool, or at least the outer components thereof, out of the well bore. In drilling, a drill bit or mill is used to cut and grind up the components of the bridge plug to remove it from the wellbore.

Drillable bridge plugs are typically constructed of a metal such as cast iron that can be drilled out. One typical problem with conventional drillable bridge plugs is that cast iron is difficult to drill out. This may result in extremely long drill-out times, excessive casing wear, or both. Long drill-out times are highly undesirable as rig time is typically charged by the hour. Additionally, the mandrel often falls out of the backup rings and slip assemblies once a single key locking the upper assembly and the mandrel is drilled out. The falling mandrel may damage other components below the plug in the well. Another typical problem with conventional drillable plugs is that cast iron plugs are generally required to be robust to achieve an isolating seal. These typical plugs, thus require that significant weight be applied to the drill bit in order to drill the plug out. It would be desirable to create a plug that did not require significant forces to be applied to the drill bit such that the drilling operation could be accomplished with a coiled tubing motor and bit.

Some embodiments of drillable plugs known in the prior art solve this problem by providing an apparatus wherein at least some of the components, including pressure bearing components, are made of non-metallic materials, such as engineering grade plastics, or composite materials. Examples of a composite bridge plug may be found in U.S. Pat. No. 6,796,376 B2, issued to Frazier, and is incorporated by reference in its entirety. Such plastic or composite components are much more easily drilled than cast iron. However, when several plugs are used in succession to isolate a plurality of zones within the well bore, there may be significant heat and pressure on the plug from either side. Plugs with pressure bearing components made of non-metallic material tend to fail at high temperature and pressure. Composite materials may have a faster drill out, but the reliability is lower due to a tendency to delaminate. The fabrics from composite materials tend to string out, or ball up, thus plugging up the production line. Additionally, the fabrics, because of their low mass, often float up with the gas into the production line, possibly causing plugs or failure of the production lines.

In other embodiments known in the prior art, some components of the plug are made of aluminum alloys. Plugs made of aircraft quality aluminum alloys in the prior art, when drilled, often result in a "gummy" material, wherein the material "balls" during milling or drilling. That is, the material melts and then cools during the drilling process. As the aluminum material of the prior art plugs melts and cools during drilling, it adheres to the cutting structure of the drill, thereby making the drilling process less efficient.

SUMMARY OF INVENTION

In one aspect, the invention provides drillable bridge plug. In one aspect, the bridge plug comprises a mandrel, a sealing element disposed around the mandrel, a plurality of backup rings adjacent the sealing element, a lower slip assembly, and an upper slip assembly. Additionally, in one aspect, the bridge plug comprises an upper cone adjacent the upper slip assembly and engaged with the mandrel with at least one axial locking apparatus and at least one rotational locking apparatus, and a lower cone adjacent the lower slip assembly and engaged with the mandrel with at least one axial locking apparatus and at least one rotational locking apparatus.

In another aspect, the invention provides a drillable bridge plug comprising a mandrel and at least one slip assembly at least partially made of a material having less than 10% elongation.

Other aspects and advantages of the invention will be apparent from the following description and the appended claims.

DETAILED DESCRIPTION

In order to reduce drill-out times for removing a bridge plug, it is desirable to design a bridge plug that can be more easily drilled, while still maintaining the structural integrity of the bridge plug. Additionally, it is desirable to obtain a bridge plug that causes the least amount of damage to the casing and other components in the wellbore during the drill out process. Embodiments of the invention advantageously provide a bridge plug formed of materials that allow for faster, more efficient drill-outs of the bridge plug. Additionally, embodiments of the invention provide mechanical components of a bridge plug that prevent damage to other wellbore tools or components during the drill-out of a bridge plug.

Figure 1:
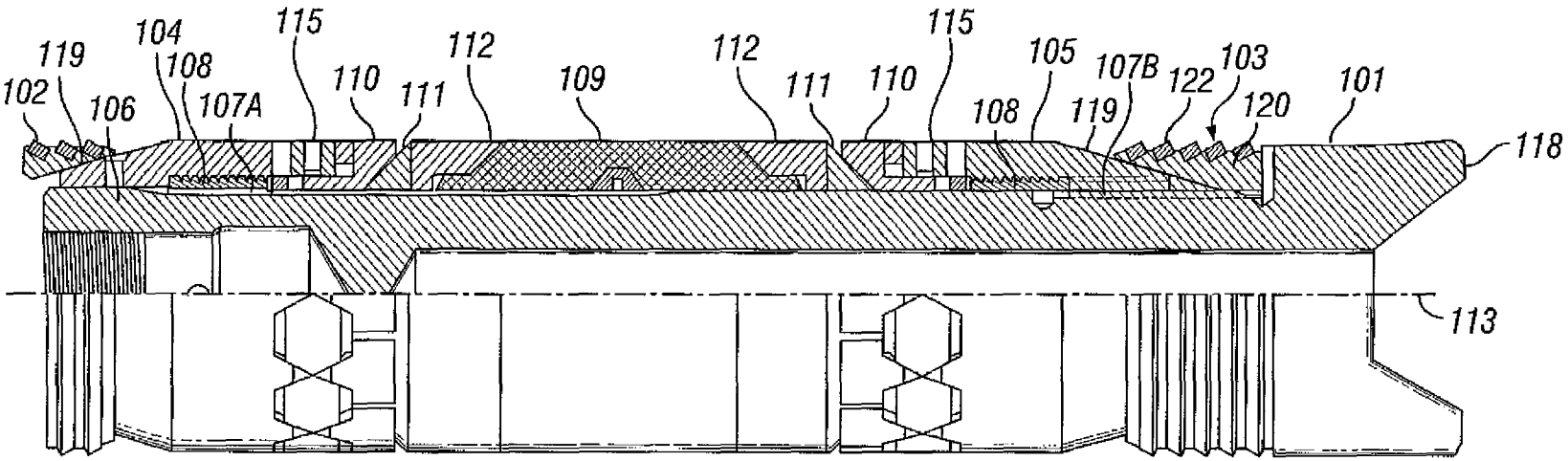
FIG. 1 is a cross-sections partial side view of a drillable bridge plug according to an embodiment of the invention.

In one embodiment, as shown in FIG. 1, a drillable plug 100 comprises a central mandrel 101, about which most of the other components are mounted. An upper slip assembly 102 and a lower slip assembly 103 are provided adjacent an upper cone 104 and a lower cone 105, respectively. The upper cone 104 is held in place on the mandrel 101 by one or more shear screws 106. Axial locking apparatus 108, for example lock rings, are disposed between the mandrel 101 and the upper cone 104, and between the mandrel and the lower cone 105. Additionally, at least one rotational locking apparatus 107A, 107B is disposed between the mandrel 101 and the each of the upper cone 104 and the lower cone 105, thereby securing the mandrel 101 in place in the bridge plug 100 during the drilling or milling operation used to remove the bridge plug. During drilling/milling, the upper locking apparatus 107A and the lower locking apparatus 107B secure the mandrel 101 to the bridge plug 100, preventing the mandrel 101 from spinning and thereby separating from the bridge plug 100, dramatically reducing the drill time. In one embodiment, the at least one locking apparatus 107A, 107B comprise, for example, keys. During drilling/milling, the upper and lower locking apparatuses 108 secure the mandrel to the bridge plug 100, preventing the mandrel 101 from separating from the bridge plug 100 and falling down the wellbore and damaging equipment below. After the upper portion of the bridge plug 100 is drilled away, the lower locking apparatus 108 secures the mandrel 101 to the bridge plug 100 until the lower locking apparatus 108 is milled away.

When the plug 100 is set, the shear screw 106 is sheared, pushing the upper and lower cones 104, 105 along the mandrel 101 and forcing the upper and lower slip assemblies 102, 103, the backup rings 110, 115, and a sealing element 109 radially outward. The plug 100 is configured to be set by wireline, hydraulically on coil tubing, or conventional drill string.

Figure 9:
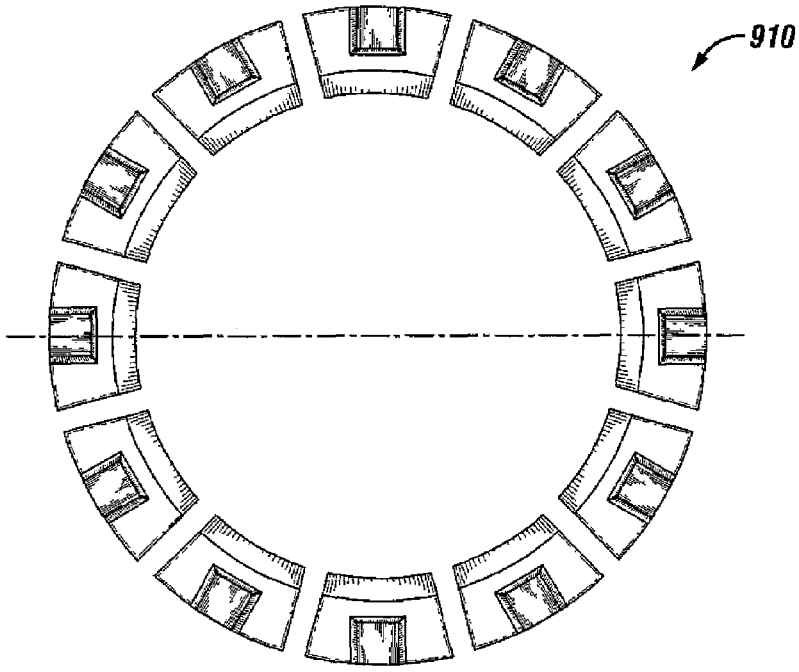
FIG. 9 is a top view of a segmented ring according to an embodiment of the invention.
Figure 10:
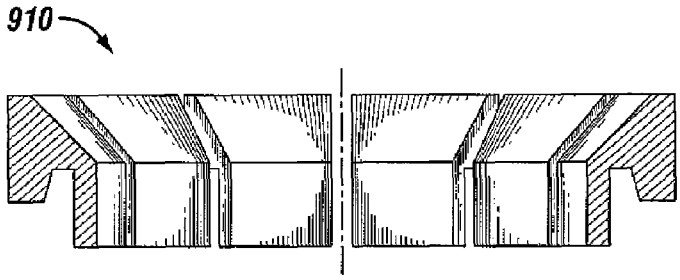
FIG. 10 is a side view of the segmented ring of FIG. 9.
Figure 11:
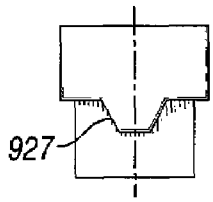
FIG. 11 is a partial view of the segmented ring of FIG. 9.

A plurality of backup rings 110, 111, 112, 115 are adjacent each side of the sealing element 109 and the upper and lower cones 104, 105. In one aspect of this invention, the plurality of backup rings 110, 111, 112, 115 provided about the mandrel 101 include a segmented backup ring 110 comprising a plurality of triangular segments 927 (FIG. 11), a frangible backup ring 115, a non-frangible, sacrificial, backup ring 112, and a solid backup ring 111. The segmented backup ring 110 may nest inside the frangible backup ring 115 that has a complementary triangle shape. An interlocking profile engages the segmented backup ring 110 and the frangible backup ring 115. The mating surfaces between the backup rings 110 and 115 are characterized by tongues and grooves such that the frangible backup ring 115 is caused to split and expand radially when the "wedge" of the segmented backup ring 110 is forced against the mating surfaces of the frangible backup ring 115. Initially, the backup rings are spaced a distance away from each other such that the wedge will have enough travel to split the frangible backup ring 115 into a number of segments that will be substantially and uniformly disposed in the fully expanded condition. Additionally, a lip of the segmented backup ring 110 closes the extrusion space between the cones 104, 105 and radial cracks of the frangible backup ring 115, thereby effectively preventing extrusion of the sealing element 109. Alternate views of a segmented backup ring 910. in accordance with embodiments disclosed herein, are shown in FIGS. 9 and 10.

Figure 3:
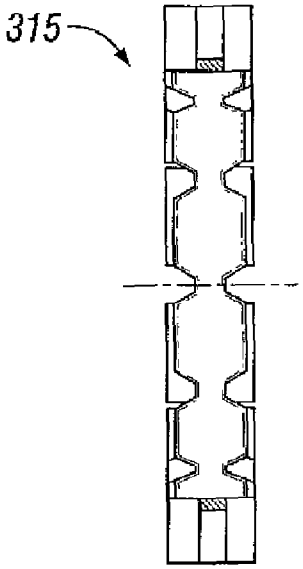
FIG. 3 is a side cross-sectional view of the frangible backup ring of FIG. 2.
Figure 4:
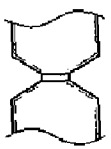
FIG. 4 is a partial outer side view of the frangible backup ring of FIG. 2.
Figure 2:
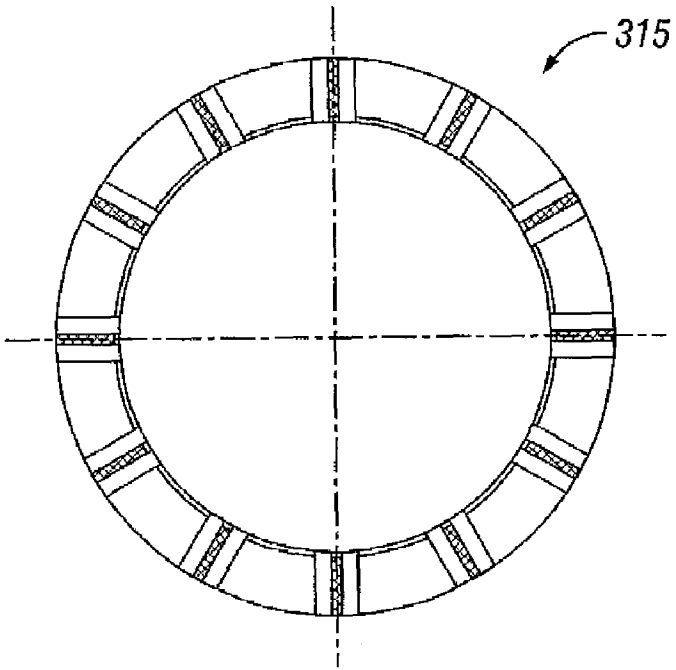
FIG. 2 is a top view of a part of a frangible backup ring according to an embodiment of the invention.

In accordance with one embodiment of the invention, the segmented backup ring 110 may be machined at the nominal inner diameter of the largest casing (not shown) in which the bridge plug 100 is to be set, while the frangible backup ring 115 is machined at the outside diameter of the bridge plug 100. When the plug is set in light weight casing, the frangible backup ring 115 is expanded radially. The radius of curvature of the segmented backup ring 110 matches the radius of curvature of the casing (not shown) to reduce the possibility of the sealing element 109 extruding over the backup rings 110, 111,112, 115. When the plug is set in heavy weight pipe, the frangible backup ring 115 is a better match to the radius of the casing (not shown) and minimizes the space between the segments for extrusion. This tongue and groove type arrangement effectively blocks the space created by the expansion of the rings with the mating segment. Alternate views of a frangible backup ring 315 are shown in FIGS. 2-4. Specifically, FIG. 2 shows a top view of a part of a frangible backup ring 315 in accordance with embodiments disclosed herein. FIG. 3 shows a side cross-sectional view of the frangible backup ring 315 of FIG. 2. FIG. 4 shows a partial outer side view of the frangible backup ring 315.

In accordance with one embodiment, the mandrel 101 also comprises a beveled tongue bottom 118 designed to prevent the bottom from turning over with respect to the centerline 113 of the bridge plug 100 inside the casing when it falls after the bridge plug 100 has been drilled out. That is, the double bevel tongue keeps the bottom straight as it falls down the pipe after milling or drilling out the plug.

In a select embodiment, one or more of the backup rings 110, 111, 112, 115 may be made from a plastic type material, such as phenolic molding compounds. Example materials distributed by Custom Rubber Products, Inc. and their material properties are listed in Table 1. Other similar materials include Lytex 9063 by Quantum Composites and RX647 by American Rogers Corporation. Additionally, materials other than plastic having the same properties as listed in Table 1, may also be used. One advantage of utilizing the plastic type material is that when pressure is applied to the backup rings, the backup rings are deformed together. This assists in sealing off any leak points, while at the same time having strength to hold the sealing element 109 from extrusion.

TABLE 1

Custom Rubber Products, Inc. Material Properties

| Material | 2070A | 2092A | 2047A | 2061A |
|---|---|---|---|---|
| Specific Gravity | 1.82 | 1.76-1.80 | 1.90 | 1.89 |
| Impact Strength (ft-lb/in) | 35 | 20 | 0.7 | 2.2 |
| Flexural Strength (PSI) | 66,000 | 35,000 | 22,000 | 16,600 |
| Tensile Strength (PSI) | 35,000 | 16,000 | 10,500 | 11,500 |
| Compressive Strength (PSI) | 45,000 | 35,000 | 35,000 | 29,600 |
| Deflection Temperature (° F. @ 264 PSI) | 570 | 500 | 530 | 600 |
| Dielectric Strength (v/mil) | 400 | 400/320 | 320 | 320 |

In an alternative embodiment, the backup rings are made from low yield cast aluminum or a similar material. When choosing an aluminum alloy to use, it is preferable to select a material with a relatively low yield point and low elongation, because this combination of properties makes the aluminum brittle. The inventors have found that this brittle aluminum is more easily drillable downhole. When a component of a bridge plug that is made of a low yield cast aluminum casting is drilled, the bridge plug breaks up into "chips," or small aluminum pieces due to the brittle nature of the cast aluminum. The aluminum does not ball or adhere to the drilling cutting structure, thus making the drilling process more efficient. The small aluminum chips can also more easily be flushed out of the line without plugging. Additionally, the weight of the aluminum chips is heavy enough to prevent the pieces from floating up into the production line.

A relatively low yield for an aluminum alloy, for example, may be approximately 25,000 psi at 75° F., and a low elongation may be approximately less than 10%, at 75° F. In a preferred embodiment, the aluminum alloy has a yield of less than 25,000 psi at 75° F., and an elongation of 3%-5%, at 75° F. Example aluminum alloys include 356-T6, 355-T51, 355-T6, and 142-T77, available from Aluminum Company of America, but alternative cast aluminum alloys with similar characteristics may be used as well. Table 2, below, summarizes material properties of the previously listed aluminum alloys for reference.

TABLE 2

Aluminum Alloy Material Properties

| | 356-T6 | | 355-T51 | | 355-T6 | | 142-T77 | |
|---|---|---|---|---|---|---|---|---|
| | @75° F. | @500° F. | @75° F. | @500° F. | @75° F. | @500° F. | @75° F. | @500° F. |
| Tensile Ultimate Strength (PSI) | 33,000 | 7,500 | 28,000 | 9,500 | 35,000 | 9,500 | 30,000 | 13,000 |
| Tensile Yield Strength (PSI) | 24,000 | 5,000 | 23,000 | 5,000 | 25,000 | 5,000 | 23,000 | 8,000 |
| Elongation in 2 inches (%) | 3.5 | 35.0 | 1.5 | 16.0 | 3.0 | 16.0 | 2.0 | 6.0 |

In another aspect of the invention, at least one of the previously described components of the bridge plug 100, such as the mandrel 101, upper and lower cones 104, 105, and slip assemblies 102, 103, comprise low yield cast aluminum. In a preferred embodiment, the material is aluminum alloy 356-T6. In one embodiment, the slip assemblies 102, 103 may comprise low yield cast aluminum and cast iron. Alternative cast aluminum alloys with similar characteristics, examples shown in Table 2, may be used as well.

Figure 7:
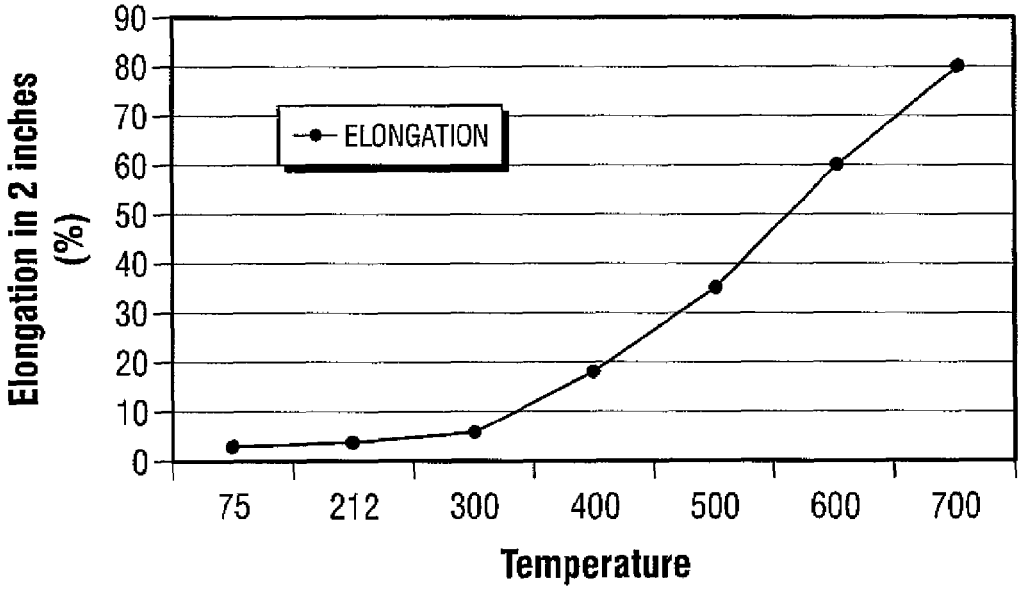
FIG. 7 shows a plot of elongation of a bridge plug material according to an embodiment of the invention.
Figure 8:
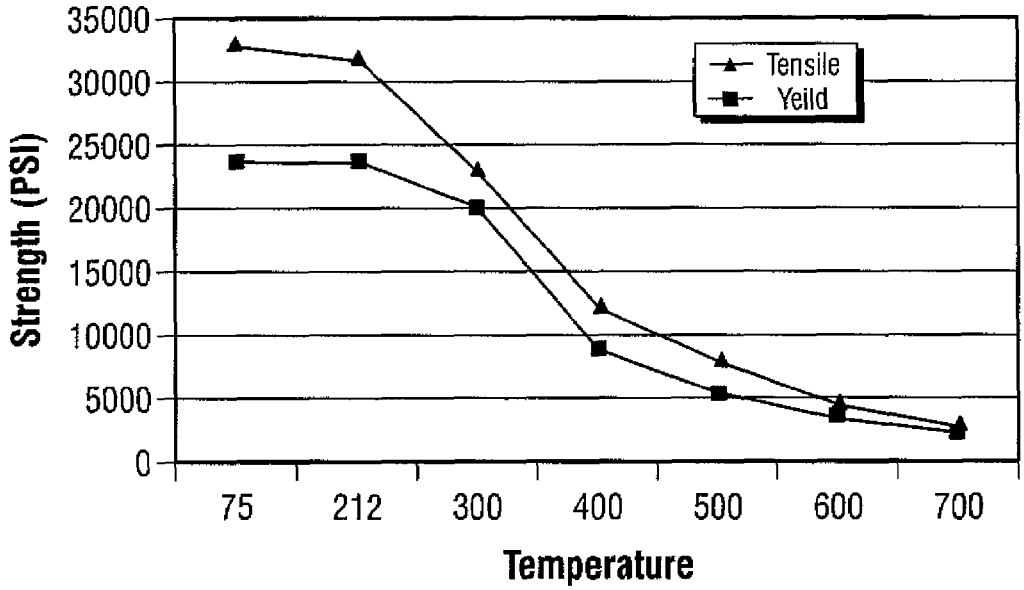
FIG. 8 shows a plot of the tensile and yield strengths of a bridge plug material according to an embodiment of the invention.

In addition, the aluminum alloys lose strength at high temperatures which must be considered when selecting materials. In a preferred embodiment, low yield cast aluminum alloy 356-T6 is used to create components of bridge plug 100. FIGS. 7 and 8 show typical properties and chemical compositions, including the temperature duration curves, for cast aluminum alloy 356-T6.

Those having ordinary skill in the art will recognize that materials other than aluminum may be used, so long as they have the appropriate properties. For example, embodiments of the present invention may encompass materials having elongations of less than 10%.

In another aspect of this invention, the bridge plug is required to hold heavy differential loads and still be easily drilled up. To achieve this result, in one embodiment, the slip assemblies 102, 103 (FIG. 1) comprise a slip base 120 with slip teeth 122. The slip teeth 122 engage an inner wall of the casing (not shown) once the bridge plug 100 is set. In one embodiment, the slip base 120 and the slip teeth 122 are created from two different materials. In one embodiment, the slip base 102 is a readily drillable material, and the slip teeth 122 are a hard material that will bite or penetrate the casing wall. In a preferred embodiment, the slip base 120 is low yield cast aluminum, for example a cast aluminum as described in Table 2 above, and the slip teeth 122 are hardened cast iron. The hardened cast iron slip teeth 122 bite or grip the inner wall of the casing. By creating the slip base 120 from low yield cast aluminum, the bridge plug 100 is more easily and efficiently drilled up, without balling.

As used herein, the term low yield cast aluminum refers to aluminum containing compositions having an elongation of less than 10%.

Figure 6:
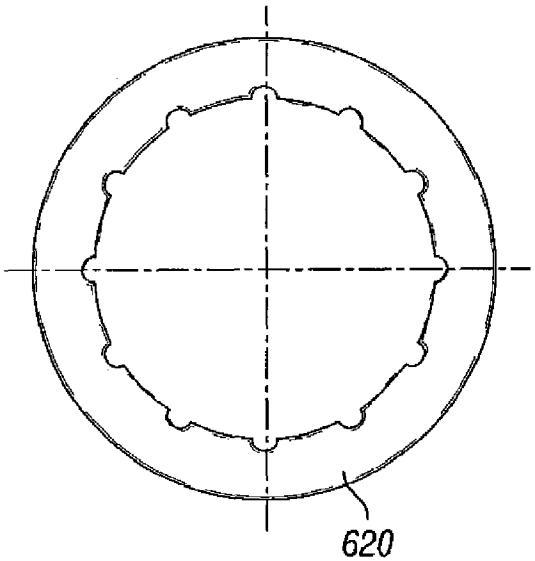
FIG. 6 is a top view of a slip base according to an embodiment of the invention.
Figure 5:
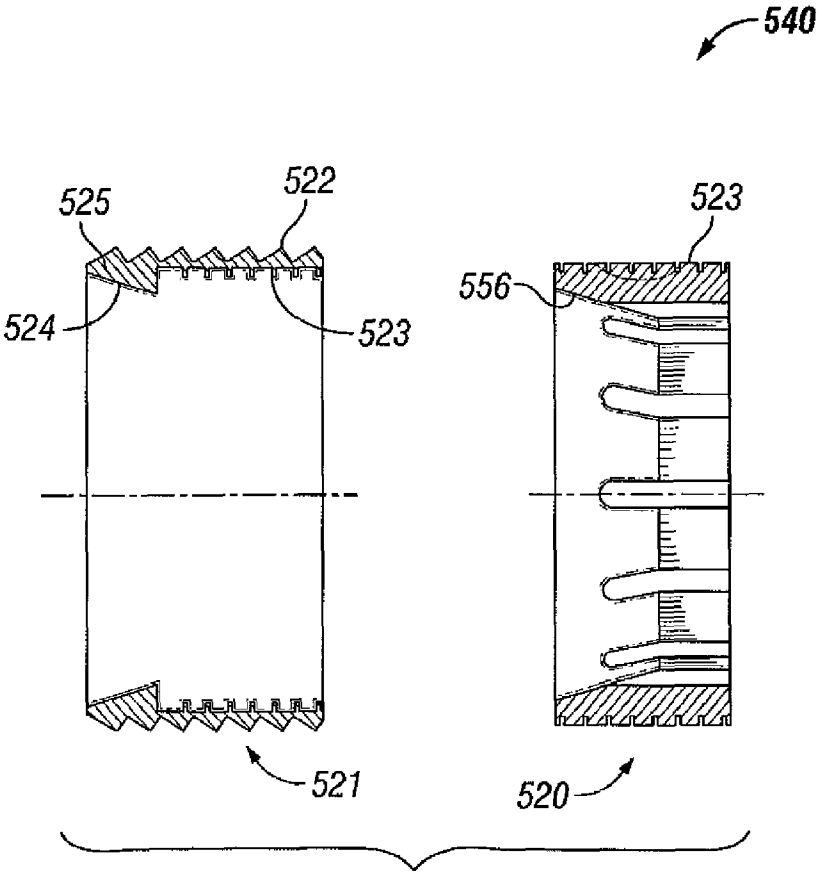
FIG. 5 is a side cross-sectional view of an unassembled slip assembly according to an embodiment of the invention.

In another embodiment, shown in FIG. 5, a slip assembly 540 comprises a slip base 520 and a mating slip ring 521. Note, that when assembled, slip base 520 and mating slip ring 521 are aligned so that a wedge surface 524 of the mating slip ring 521 is proximate the slant surface 556 of the slip base 520. (A top view of a slip base 620 is shown in FIG. 6 in accordance with embodiments disclosed herein.) In one embodiment, the mating slip ring 521 has integrally formed slip teeth 522. The mating slip ring 521 is adapted to engage the slip base 520. In one embodiment, the mating slip ring 521 threadedly engages 523 the slip base 520. In one embodiment, the slip base 520 is a ready drillable material, while the slip teeth 522 of the mating slip ring 521 are a hard material that will bite or penetrate the casing wall. In a preferred embodiment, the slip base 520 is low yield cast aluminum, and the slip teeth 522 of the mating slip ring 521 are cast iron.

The mating slip ring 521 may further comprise a wedge surface 524 disposed on the inside diameter at an end 525 of the mating slip ring 521. When the slip assembly 540 is assembled on the bridge plug 100 (FIG. 1), the wedge surface 524 is disposed adjacent the outer surface 119 of the cones 104, 105. The wedge surface 524 holds a substantial load when the bridge plug 100 is set in the wellbore. In one embodiment, the wedge surface 524 is created of a hard material to allow the assembly to hold a higher load. In a preferred embodiment, the wedge surface 524 is cast iron, which allows the assembly to hold a higher load.

An alternative embodiment comprises a slip base that has a thread cut along the outer periphery to receive a spring-like mechanism that is wound of a rectangular or triangular shape such that the inner diameter geometry fits tightly into the thread of the slip base. The outer edge of the spring is hardened to bite the casing when the slip assembly is expanded.

In another embodiment, the slip base has equally spaced grooves along the outer periphery. A "C" type retaining ring is installed in each of the grooves such that the retaining rings are tight in the bottom of the groove but are free to expand when the slip base moves outwardly to contact the casing. The retaining rings are of substantially rectangular shape which has been rotated around one of the inside corners so that one of the external edges is exposed. In one embodiment, the retaining rings are hardened so that they will bite the pipe when expanded to touch the casing wall. In one embodiment, the retaining rings are frangible, so they break into smaller pieces during the expansion periods, which aids in their removal during the drill out operation.

Operation

The drillable bridge plug may be set by wireline, coil tubing, or a conventional drill string. In one embodiment, the plug is placed in engagement with the lower end of a setting tool that includes a latch down mechanism and a ram. The present plug is then lowered through the casing to the desired depth and oriented to the desired orientation.

When setting the plug, a setting tool pulls upwardly on the mandrel shearing the shear screw 106 and pushing the upper and lower cones 104, 105 along the mandrel. This forces the upper and lower slip assemblies 102, 103, backup rings 110, 115, and 112, and the sealing element 109 radially outward, thereby engaging the slip teeth 122 on the upper and lower assemblies 102, 103 with the inside wall of the casing. The frangible ring 115 splits and expands radially as the non-frangible ring 111 is forced against the mating surfaces of the frangible ring 115. The segmented backup ring 110 closes the extrusion space between the upper cone 104 and the radial cracks of the frangible ring 115, thereby effectively preventing extrusion of the sealing element 109.

Advantages of embodiments having one or more aspects of the invention may include one or more of the following: A bridge plug that can be removed from the wellbore in reduced drill-out times. A bridge plug that reduces excessive casing wear during removal of the plug. A bridge plug that can be drilled or milled out of the casing with less force. A bridge plug that maintains the mandrel in the plug throughout drill-out. A bridge plug what will drill out without the material balling up on the cutting structure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drillable bridge plug comprising:

a mandrel;

a sealing element disposed around the mandrel;

a plurality of backup rings adjacent the sealing element;

a lower slip assembly disposed around the mandrel;

an upper slip assembly disposed around the mandrel;

an upper cone adjacent the upper slip assembly and engaged with the mandrel with at least one axial locking apparatus and at least one rotational locking apparatus; and a lower cone adjacent the lower slip assembly and engaged with the mandrel with at least one axial locking apparatus and at least one rotational locking apparatus wherein the plurality of backup rings further comprises a frangible backup ring adjacent a segmented backup ring.

2. The drillable bridge plug of claim 1, wherein the plurality of backup rings comprises a solid backup ring adjacent the segmented backup ring.

3. The drillable bridge plug of claim 1, further comprising an interlocking profile configured to engage the frangible backup ring and the segmented backup ring.

4. The drillable bridge plug of claim 1, further comprising a beveled tongue bottom on the mandrel.

5. The drillable bridge plug of claim 1, wherein the lower slip assembly comprises a mating slip ring disposed around a slip base, wherein the mating slip ring comprises a plurality of slip teeth disposed on the outside diameter.

6. The drillable bridge plug of claim 5, wherein the mating slip ring further comprises a wedge surface disposed on inside diameter.

7. The drillable bridge plug of claim 6, wherein the wedge surface on the inside diameter of the mating slip ring is made of cast iron.

8. The drillable bridge plug of claim 5, wherein the plurality of slip teeth of the slip ring are made of cast iron, and slip base is made of cast aluminum.

9. The drillable bridge plug of claim 1, further comprising an upper cone disposed adjacent the upper slip assembly, and a lower cone disposed adjacent the lower slip assembly.

10. The drillable bridge plug of claim 9, wherein the upper cone and the lower cone are formed from low yield cast aluminum.

11. The drillable bridge plug of claim 1, wherein the plurality of backup rings are formed from a non-metallic substance.

12. The drillable bridge plug of claim 1, wherein the mandrel is formed from low yield cast aluminum.

13. The drillable bridge plug of claim 1, wherein the at least one rotational locking apparatus comprises a key.

14. The drillable bridge plug of claim 13, wherein the at least one slip assembly further comprises a mating slip ring and a slip base.

15. The drillable bridge plug of claim 14 wherein the mating slip ring comprises a wedge surface disposed on the inside diameter.

16. The drillable bridge plug of claim 15 wherein the slip base is made of low yield cast aluminum.

17. The drillable bridge plug of claim 16 wherein the wedge surface on the inside diameter of the mating slip ring is made of cast iron.

* * * * *